US007529496B2

(12) United States Patent
Dan

(10) Patent No.: US 7,529,496 B2
(45) Date of Patent: May 5, 2009

(54) IMAGE FORMING APPARATUS WITH JOB IDENTIFICATION FEATURE

(75) Inventor: Kenichi Dan, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 11/509,578

(22) Filed: Aug. 25, 2006

(65) Prior Publication Data

US 2007/0047975 A1 Mar. 1, 2007

(30) Foreign Application Priority Data

Aug. 31, 2005 (JP) ..... 2005-251209

(51) Int. Cl.
*G03G 15/00* (2006.01)

(52) U.S. Cl. ..... 399/82; 358/3.31; 399/382; 270/58.31

(58) Field of Classification Search ..... 399/8, 399/82, 382; 358/3.31; 270/58.31
See application file for complete search history.

(56) References Cited

U.S. PATENT DOCUMENTS 5,848,346 A * 12/1998 Takashiro ..... 399/404
5,960,247 A 9/1999 Morikawa
2002/0075497 A1* 6/2002 Mantell ..... 358/1.13
2005/0137941 A1 6/2005 Fujinawa

FOREIGN PATENT DOCUMENTS

| | | | |
|---|---|---|---|
| JP | 63-011301 A | | 11/1994 |
| JP | 9-8993 | | 1/1997 |
| JP | 10-143017 | | 5/1998 |
| JP | 11-084948 A | | 3/1999 |
| JP | 2000-098824 A | | 4/2000 |
| JP | 2002-90897 | | 3/2002 |
| JP | 2003246113 A | * | 9/2003 |
| JP | 2004-229236 A | | 8/2004 |
| JP | 2005-181841 A | | 7/2005 |

OTHER PUBLICATIONS

Translation of JP 09008993A.*
Abstract of JP 2003246113A.*
JP Office Action dtd Dec. 16, 2008, JP Appln. 2005-251209, partial translation.

* cited by examiner

*Primary Examiner*—David M Gray
*Assistant Examiner*—Bryan Ready
(74) *Attorney, Agent, or Firm*—Banner & Witcoff, Ltd

(57) ABSTRACT

An image forming apparatus includes: an image forming unit that forms an image on both surfaces of a recording medium; and a control unit that controls the image forming unit to form an image so that the image expresses information of a user who uses the image forming apparatus or a job, on a rear surface of a recording medium that includes an image of a first page or a last page of the user's job.

13 Claims, 9 Drawing Sheets

IMAGE FORMING APPARATUS WITH JOB IDENTIFICATION FEATURE

CROSS-REFERENCE TO THE RELATED APPLICATION(S)

This application is based upon and claims priority from prior Japanese Patent Application No. 2005-251209 filed on Aug. 31, 2005, the entire contents of which are incorporated herein by reference.

TECHNICAL FIELD

This invention relates to an image forming apparatus such as a laser printer and a complex printer including a facsimile function.

BACKGROUND

Nowadays, a printer that can be shared by a plurality of users has become a mainstream. In the printer, a sheet, which is printed out by one user, and a sheet, which is printed out by another user, exist in a mixed manner on a sheet ejection tray. Therefore, each user has to distinguish the sheet by flipping a bundle of sheets on the sheet ejection tray each time and checking a printed content of a last sheet of a job. It is difficult to use.

According to JP-A-10-143017, a copying machine outputs a slip sheet, on which job identification information is printed, in response to completion of ejection of a sheet of a job. JP-A-10-143017 can provide a copying machine in which an operator can easily identify one's own job out of a bundle of ejected sheets of a previous job and take one's own job out.

SUMMARY

However, in JP-A-10-143017, job identification information has to be printed on a slip sheet with respect to each job. Therefore, there is a problem that sheets are wasted.

Aspects of the present invention provide an image forming apparatus which can easily distinguish a sheet that is printed out and outputted by one user, out of a bundle of sheets which is printed out and outputted by a plurality of users, and can eliminate the wasted sheets.

According to an aspect of the invention, there is provided an image forming apparatus including: an image forming unit that forms an image on both surfaces of a recording medium; and a control unit that controls the image forming unit to form an image so that the image expresses information of a user who uses the image forming apparatus or a job, on a rear surface of a recording medium that includes an image of a first page or a last page of the user's job.

According to the aspect, information, which is different with respect to a user who uses the image forming apparatus and each job, is formed on a rear surface of recording medium on which an image of a first page or a last page of one job is formed. Therefore, it is possible to easily distinguish and take out each job compared with a case of sequentially checking a content of an image formed on a recording medium in order to distinguish a recording medium of one'sown job. In addition, it is possible to prevent waste of the recording medium, such as the use of a slip sheet.

BRIEF DESCRIPTION OF THE DRAWINGS

These and other objects and advantages of the present invention will be more fully apparent from the following detailed description taken in conjunction with the accompanying drawings, in which.

DETAILED DESCRIPTION OF THE ILLUSTRATIVE ASPECTS

Figure 1:
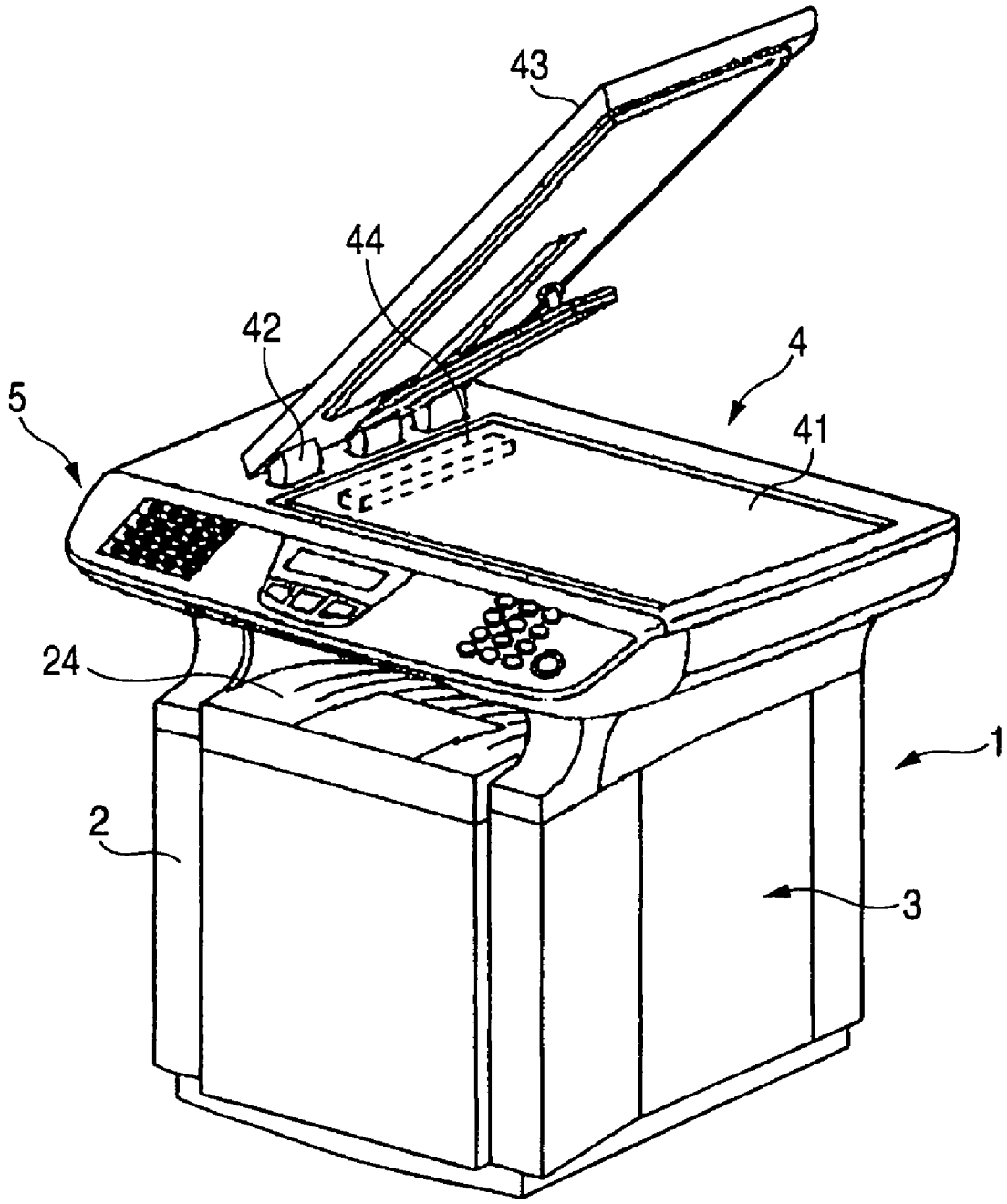
FIG. 1 is an external appearance view of a complex printer.
Figure 2:
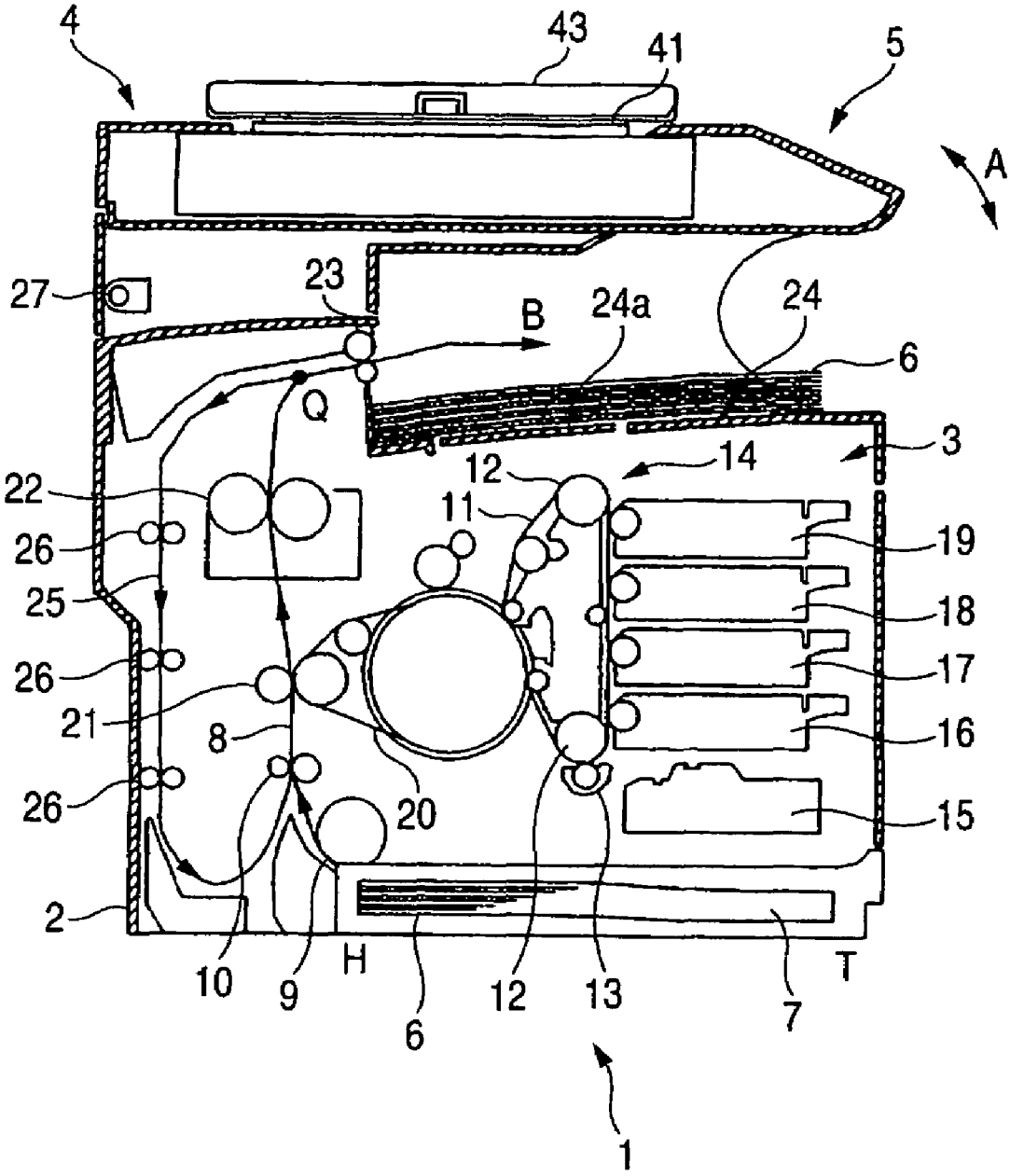
FIG. 2 is an apparatus cross sectional view which shows an entire configuration of the complex printer.

One aspect of the present invention will be explained together with figures. First, a configuration of a complex printer 1 including a print function as an image forming apparatus of the present invention, a copy function and a facsimile function will be explained with reference to FIG. 1. FIG. 1 is an external appearance view of the complex printer 1. FIG. 2 is an apparatus cross-sectional view which shows an entire configuration of the complex printer. This laser printer 1 is mainly composed of an image forming unit 3 which is disposed in a main body casing 2 and an image reading unit 4 which is disposed on the upper side of the image forming unit 3.

Meanwhile, in what follows, it is assumed, in the complex printer 1, that a side on which an operation panel 5 is disposed is "a front side" and its opposite side is "a rear side".

As shown in FIG. 2, in the image forming unit 3, a sheet feed tray 7, in which sheets 6 as recording media are stored, is disposed in a removable fashion, on its lower part. On the back side of the sheet feed tray 7, a sheet feed roller 9 for feeding a top sheet 6 of the sheets 6 accumulated in the sheet feed tray 7 toward a sheet carrying path 8 is disposed. On a sheet carrying path downstream side of the sheet feed roller 9, a resist roller 10 for resist-processing the sheet 6 fed by the sheet feed roller 9 is disposed. On the upper side of the sheet feed tray 7, a photosensitive body unit 14, in which a belt shaped photosensitive body 11, a plurality of suspension rollers 12 by which the photosensitive body 11 is suspended and is driven so as to be rotated, and a charge unit 13 which is disposed in face of one suspension roller 9 were united, is disposed in a removable fashion. In this aspect, the charge unit 13 is united with the photosensitive body unit 14, but it is also possible to make the charge unit 13 a separate body from the photosensitive body unit 14.

At a position in the vicinity of the charge unit 13 and facing the photosensitive body 11, an optical unit 15, in which a laser light source (not shown) etc. is incorporated, is disposed. At a position on the upper side of the optical unit 15 and facing a perpendicular portion of the photosensitive body 11, for example, a black development unit 16, an image forming unit in which black (Bk) toners are incorporated; a yellow development unit 17, an image forming unit in which yellow (Y) toners are incorporated; a magenta development unit 18, an image forming unit in which magenta (M) toners are incorporated; and a cyan development unit 19, an image forming unit in which cyan (C) toners are incorporated are arranged in the form of lamination layers.

In close proximity to the photosensitive body 11, an intermediate transfer belt 20 is disposed, and the intermediate transfer belt 20 faces a transfer unit 21. On the upper side of the transfer unit 21, a fixing unit 22 is disposed, on the obliquely upper side of the fixing unit 22, a sheet ejection roller 23 is disposed, and on the lower side of the sheet ejection roller 23, a sheet ejection tray 24, to which the sheet, on which an image was formed, is ejected and stocked, is disposed. The sheet ejection tray 24 is configured by a part of the main body casing 2, and a portion of the sheet ejection tray 24, which faces the photosensitive body unit 14, also faces the image reading unit 4 through a space portion for use in taking out a sheet, as shown in FIG. 2.

Meanwhile, the sheet ejection roller 23 is capable of rotating in both forward and reverse directions. When an image is formed on both surfaces of the sheet 6 (duplex printing), the sheet ejection roller 23 is driven in such a manner that the sheet 6, on which one surface an image was formed (printed), is carried to a sheet carrying path 25. In the sheet carrying path 25, a plurality of carrying rollers 26 carry the sheet 6, which was carried by the sheet ejection roller 23 to the sheet carrying path 25, to the sheet carrying path 8 again.

The image reading unit 4 is equipped with an operation panel 5 on its front side and is supported by an opening/closing support unit 27, which is disposed at a position that is on the upper side of the image forming unit 3 and far from the sheet ejection tray 24, in an openable and closable fashion. Meanwhile, the operation panel 5 is configured by keys for: selecting which function is executed among a print function, a copy function and a facsimile function; setting print job information which is formed on a rear surface of a last page of the sheet 6 on which an image was formed by 1 job (one time work from reading out image data until forming an image on the sheet 6 by the image forming unit 3); and setting print modes such as a size and a direction of the sheet 6 on which an image is formed. A display panel for displaying contents set by this key, is also formed on the operation panel 5. The opening/closing support unit 27 is composed of a support shaft and a bearing, and the image reading unit 4 is opened/closed against the image forming unit 3 in a direction of an arrow A (see, FIG. 2), centering around this opening/closing support unit 27. If the image reading unit 4 is held in such a state that it is opened completely, it is possible to exchange the photosensitive body unit 14, by opening a cover member 24*a* and pulling out the photosensitive body unit 14 and loading a new photosensitive body unit 14. In addition, the image reading unit 4 is, as shown in FIG. 1, equipped with a document table glass 41 on which a document is placed in order to read an image of the document, a document table cover 43 which is supported by a opening/closing support unit 42 against the document table glass 41 in a turnable manner and holds down a document placed on the document table glass 41, and CIS (Contact Image Sensor) 44 which reads an image formed on the document placed on the document table glass 41 and held down by the document table cover 43.

CIS 44 is a line type sensor which is disposed with its length in parallel to a side surface of the complex printer 1. A plurality of photo diodes (not shown) are lined up along its length. CIS 44 is configured in such a manner that reflected light at the time of applying strong light to a document from a light source (not shown) is received by individual diodes and light intensity (luminosity) of the reflected light is converted into an electric signal with respect to each pixel of the document. In the image reading unit 4, this electric signal is converted into digital data by an A/D converter (not shown), and thereby, it is possible to read an image formed on the document as image data.

Figure 3:
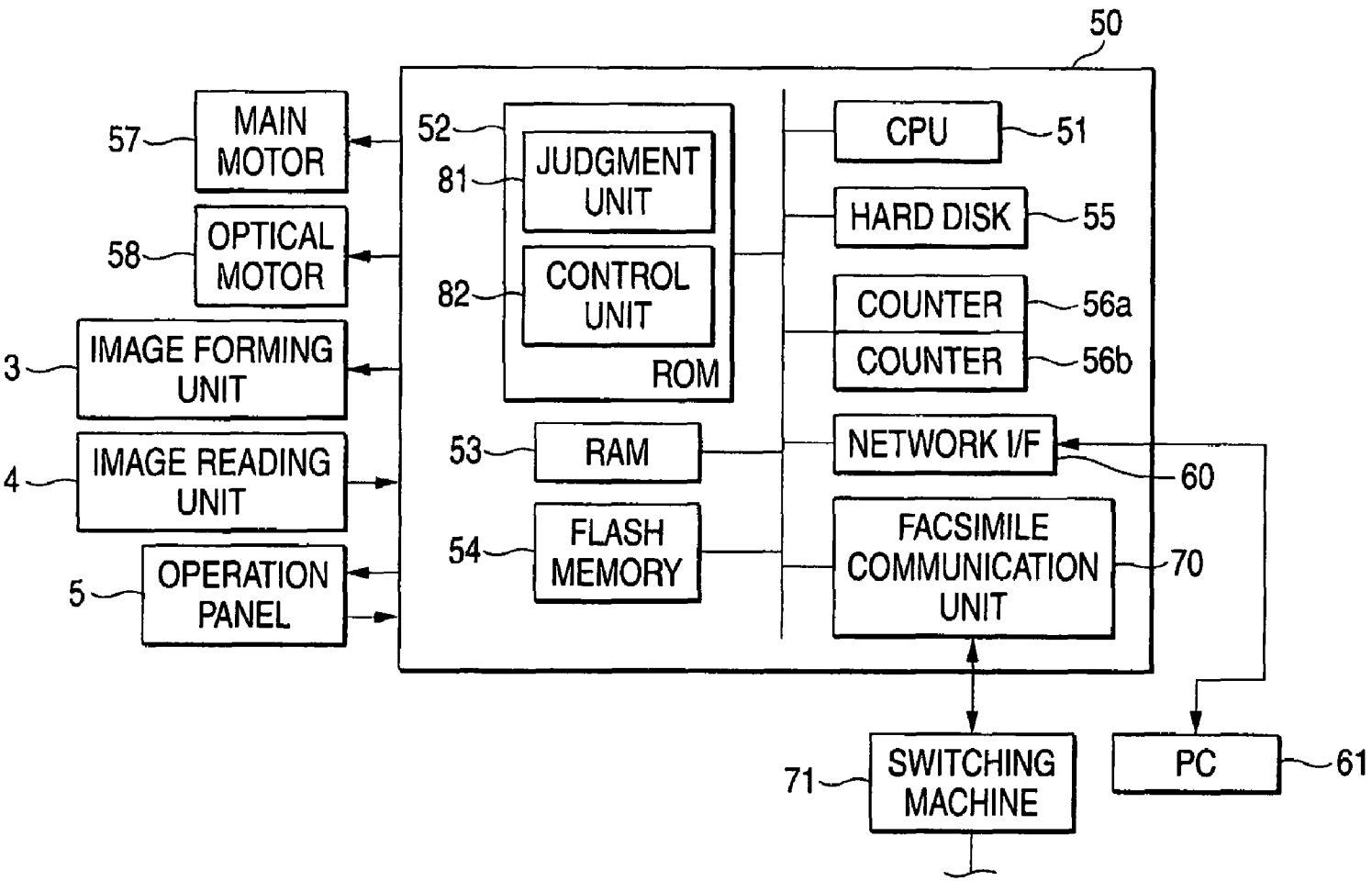
FIG. 3 is a block diagram which conceptually shows an electric configuration of the complex printer.

Next, an electric configuration of the above-described complex printer 1 will be explained by referring to FIG. 3. FIG. 3 is a block diagram which schematically shows an electric configuration of the complex printer 1.

In the complex printer 1, a control device 50, which controls each constituent element, includes CPU 51, ROM 5, RAM 53, a flash memory 54, a hard disc 55, counters 56*a*, 56*b* etc., as shown in FIG. 3. Furthermore, the following are electrically connected to the control device 50, a main motor 57 which drives the sheet feed roller 9, the suspension roller 12 of the photosensitive body unit 14 etc., an optical motor 58 which drives a polygon mirror (not shown) in an optical unit 15, the image forming unit 3, the image reading unit 4, the operation panel 5, etc. Those things make up a control system.

In addition, the control device 50 includes a network interface (network I/F) 60 for being connected to an external equipment such as a personal computer 61 and a facsimile communication unit 70 which is connected to a telephone line 72 coupled to a switching machine 71. The facsimile communication unit 70 is equipped with NCU (not shown) connected to the telephone line 72 for performing line control, a modem (not shown) for modulating and demodulating image information and then transferring it and also transmitting/receiving various procedure signals for use in transfer control, a buffer (not shown) for temporarily storing encoded image data which is transmitted/received to/from the other side communication device (e.g., facsimile device), and so on. NCU receives a calling signal which is transmitted from the switching machine 71 and a telephone number etc. of the other side communication device and transmits a dial signal at the time of transmission, which corresponds to an operation of a button disposed on the operation panel 5, to the switching machine 71. Further, NCU carries out transmission/reception of an analog audio signal at the time of talking.

ROM 52, RAM 53, the flash memory 54, and the hard disc 55 are connected to CPU 51, and CPU 51 controls each constituent element, storing its processing result in RAM 53, the flash memory 54, and the hard disc 55, in accordance with a processing procedure stored in ROM 52.

ROM 52 stores various programs such as a judgment unit 81 which judges whether or not image data is stored in the hard disc 55 and whether or not stored image data is one side printing data, a control unit 82 as a control unit which will be described later, and a program for storing a printing mode and printing job information set by the operation panel 5 in RAM 53 and the flash memory 54.

RAM 53 is equipped with a region for storing a printing mode, a printing job etc. which were set by the operation panel 5.

The flash memory 54 is equipped with a region for storing a printing mode and printing job information which were set by the operation panel 5. Even if power of the complex printer 1 is turned OFF, the stored printing job information is not erased.

The hard disc 55 is a storage device for temporarily storing image data which is transmitted from PC 61 and image data of a document which was read by the image reading unit 4. The hard disc 55 temporarily stores image data of a plurality of jobs, which was accepted by a print spooler (not shown in the figure), and the image data is sequentially sent to the image forming unit 3 by the print spooler.

The control unit 82 is a program for controlling a manner that print job information is formed on a rear surface, if an image of a previous page of a last page is not formed on the rear surface on which an image of a last page of 1 job is formed, and print job information is executed by CPU 51. Control processing for performing control so as to form print job information through the use of the control unit will be described later.

Meanwhile, the print job information is formed on a rear surface of a last page of the sheet 6 on which an image was formed in each job, so that it is possible to distinguish the sheet 6 of each job, which exists in a mixed manner on the sheet ejection tray 24, with respect to each user who uses the complex printer 1 or with respect to each job.

Next, the print job information, which is formed on a rear surface of a last page of the sheet 6 on which an image was formed in each job, will be explained by referring to FIGS. 4 through 7. Meanwhile, FIGS. 4 through 7 are views which show the sheet 6 of each job on which a sample of the print job information was formed, at the time of looking at the sheet 6 ejected onto the sheet ejection tray 24 from above in such a manner that an R side of the sheet 6 becomes an end portion close to the sheet ejection roller 23 and an S side becomes an end portion close to a front side of the complex printer 1. These sheets are drawn in such a manner that print job information with respect to each job can be seen, for the purpose of explanation.

Figure 4:
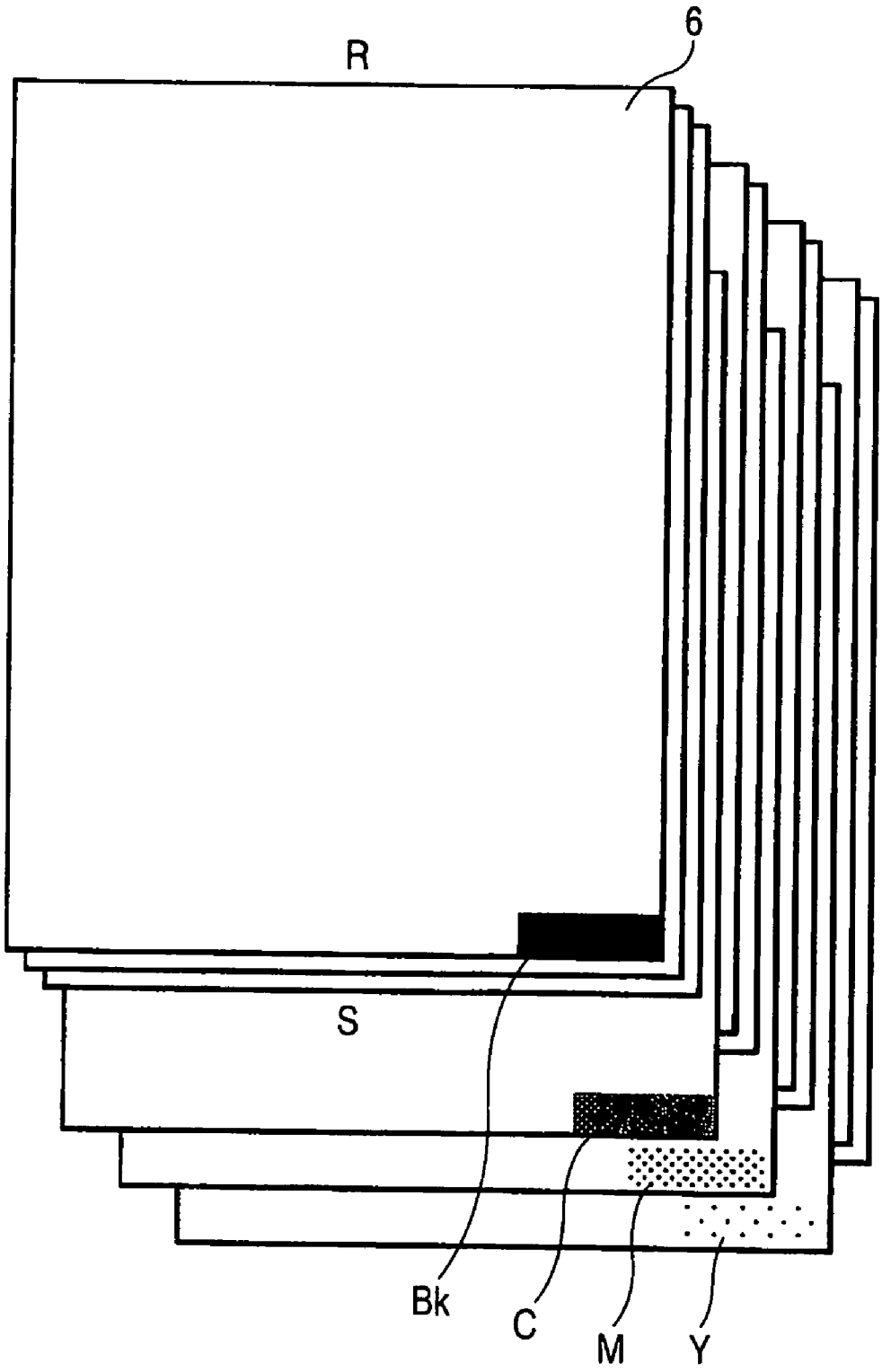
FIG. 4 is a view which shows a sheet of each job in which print job information indicated by a pattern of a different color with respect to each user or each job is formed at S side end portions of sheets.

FIG. 4 is a view which shows the sheet 6 of each job in which print job information by patterns of different colors with respect to each user or each job was formed at the S side end portion of the sheet 6.

If the operation panel 5 is set so that print job information is indicated by a pattern of a different color with respect to each user or each job, for example, as shown in FIG. 4, a pattern, which was marked out by a different color with respect to each user or each job by the development units 16 through 19 of each color of Bk, Y, M and C, is formed on a rear surface of a last page of the sheet 6 of each job. Therefore, a user, whose print job information is represented by a cyan pattern, distinguishes the sheet 6 printed by him/herself by turning over the S side end portions of a bundle of the sheets 6 and taking out a bundle of sheets from the sheet 6 immediately above the sheet 6 on which a magenta pattern was formed up to the sheet 6 on which a cyan pattern was formed. In this manner, it is possible to distinguish the sheets 6 printed by oneself, from the sheets 6 printed by other users, and further classify the sheets 6 printed by oneself into the sheets 6 with respect to each job. In addition, if print job information was formed by a pattern of a different color with respect to each user or each job, it is possible to distinguish visually the sheet 6 of a job printed by oneself instantaneously.

Figure 5:
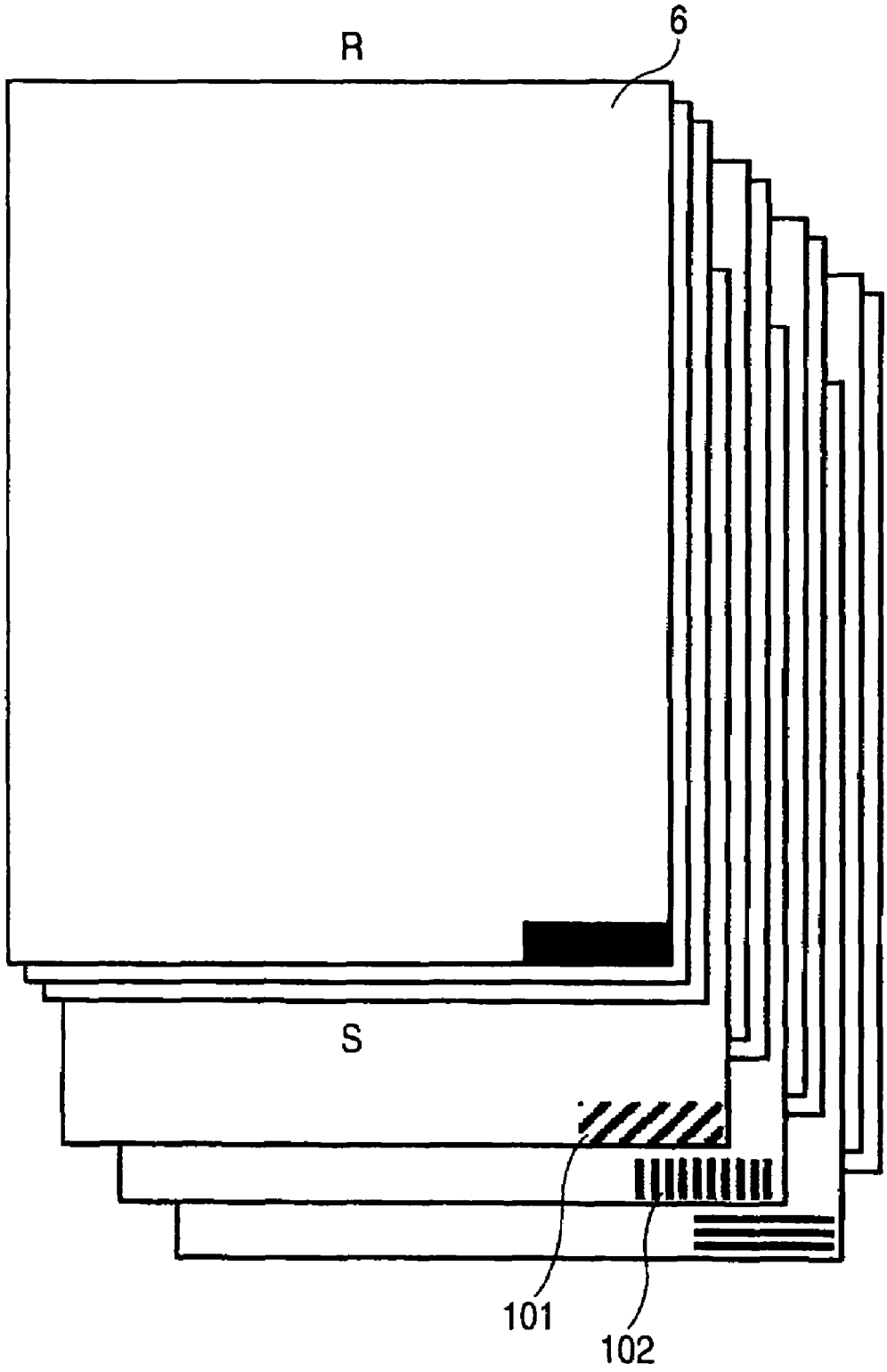
FIG. 5 is a view which shows a sheet of each job in which print job information indicated by a pattern of a different design with respect to each user or each job is formed at S side end portions of sheets.

FIG. 5 is a view which shows the sheet 6 of each job in which print job information indicated by a pattern of a different design with respect to each user or each job was formed at the S side end portions of the sheets 6.

If the operation panel 5 is set so that print job information is indicated by a pattern of a different design with respect to each user or each job, for example, as shown in FIG. 5, a pattern of a different design with respect to each user or each job is formed by the black development unit 16 on a rear surface of a last page of the sheet 6 of each job. Therefore, a user, whose print job information is represented by a pattern 101 of an oblique striped design, distinguishes the sheet 6 printed by him/herself by turning over the S side end portions of a bundle of the sheets 6 and taking out a bundle of sheets from the sheet 6 immediately above the sheet 6 on which a pattern 102 of a vertical striped design was formed up to the sheet 6 on which the pattern of the oblique striped design was formed. In this manner, if print job information was formed by a pattern of a different design with respect to each user or each job, even if a monochromatic printer which can not form a color image line is used as the complex printer 1 in this aspect, it is possible to distinguish the sheets 6 printed by oneself with respect to each user or each job.

Figure 6:
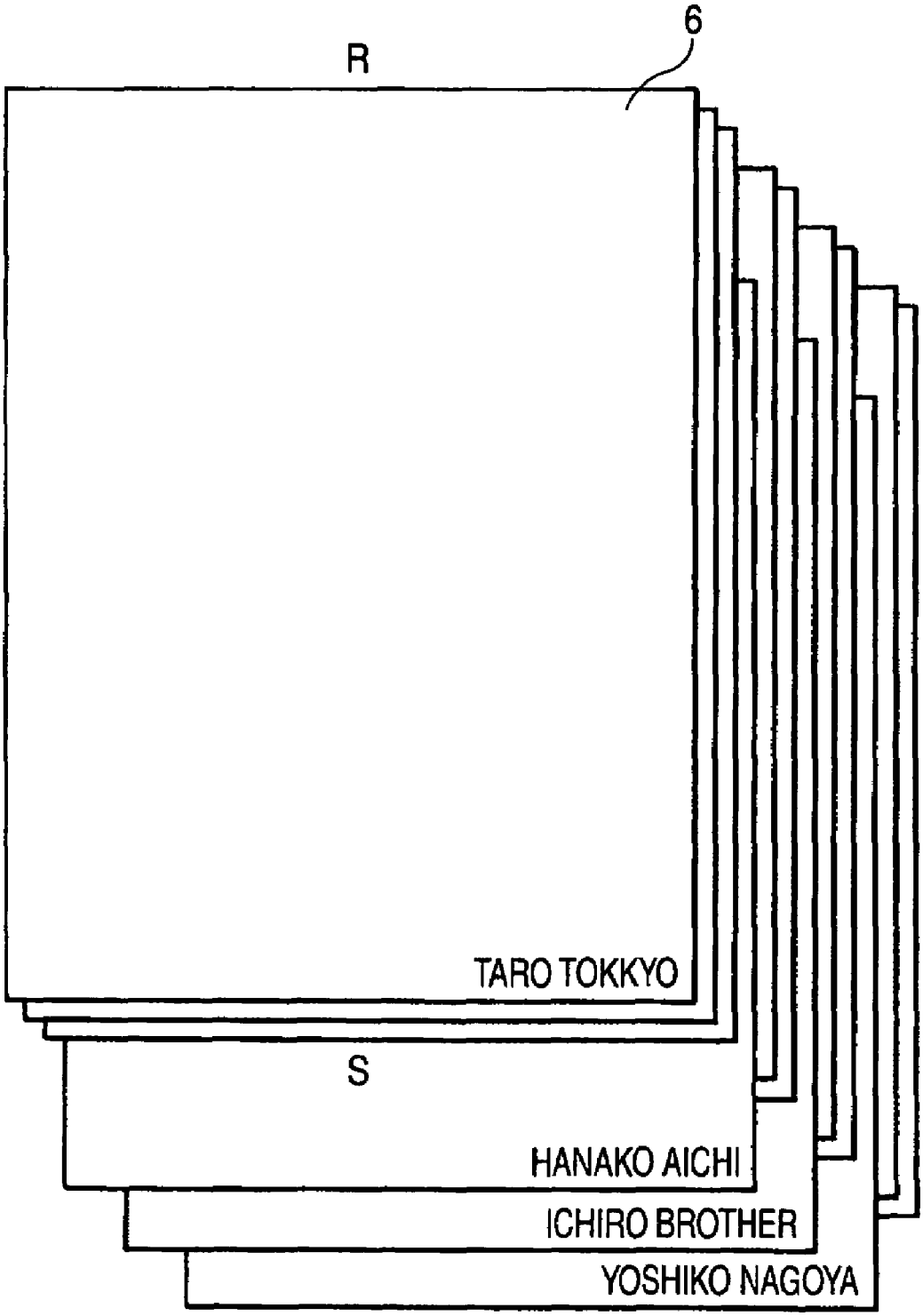
FIG. 6 is a view which shows a sheet of each job in which print job information indicated by a different individual name with respect to each user is formed at S side end portions of sheets.

FIG. 6 is a view which shows the sheet 6 of each job in which print job information indicated by a different individual name with respect to each user was formed at the S side end portions of the sheets 6.

If the operation panel 5 is set so that print job information is indicated by a different individual name with respect to each user, for example, as shown in FIG. 6, a individual name, which is different with respect to each user, is formed on a rear surface of a last page of the sheet 6 of each job, by the black development unit 16. Therefore, a user, whose print job information is represented by an individual name of "HANAKO AICHI", distinguishes the sheet 6 printed by him/herself by turning over the S side end portions of a bundle of the sheets 6 and taking out a bundle of sheets from the sheet 6 immediately above the sheet 6 on which an individual name of "ICHIRO BROTHER" was formed up to the sheet 6 on which the individual name of "HANAKO AICHI" was formed. In this manner, if print job information was formed by a different individual name with respect to each user, it is possible to surely distinguish the sheets 6 printed by oneself, without forgetting or mistaking print job information which represents the sheet 6 printed by oneself.

Figure 7:
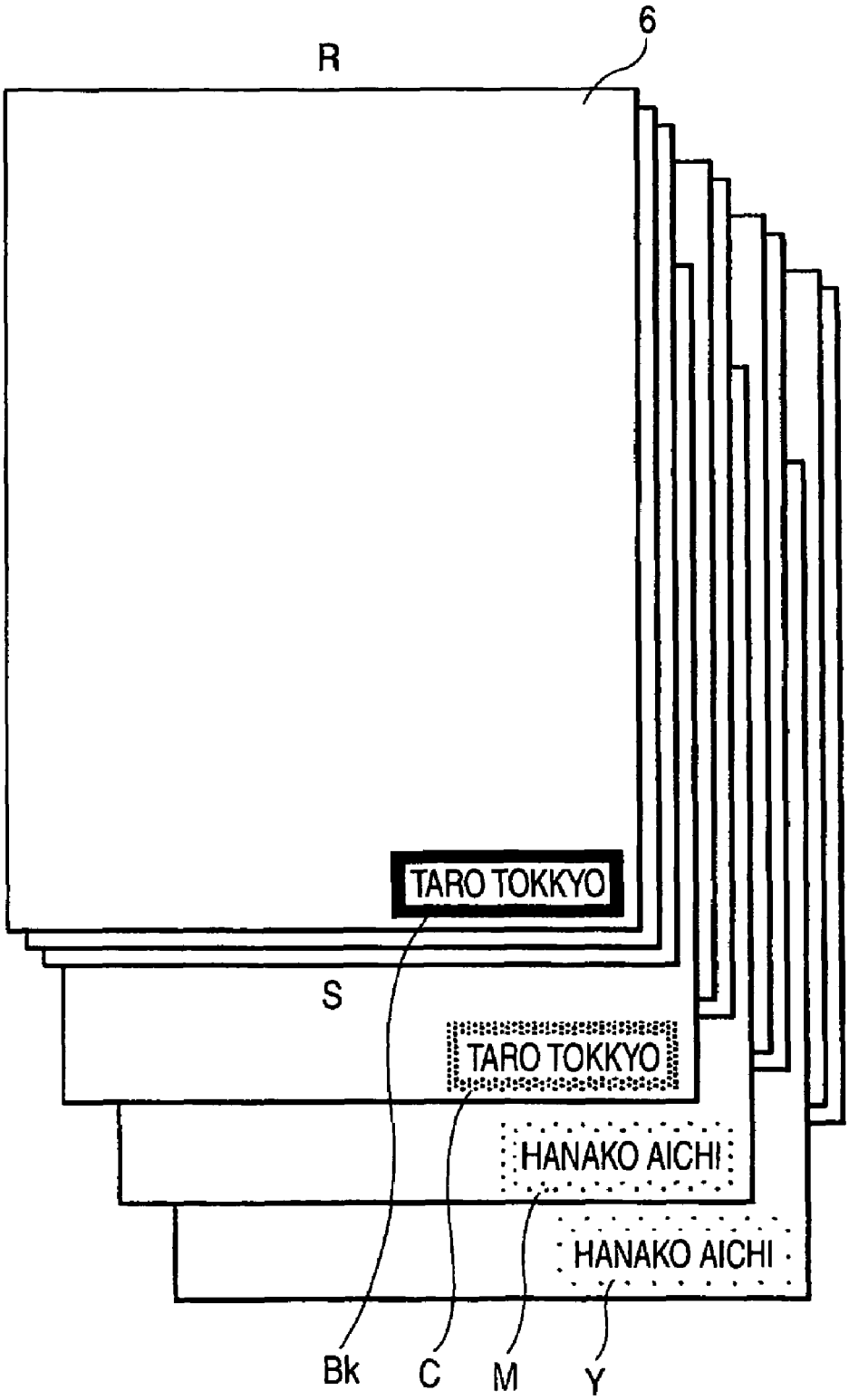
FIG. 7 is a view which shows a sheet of each job in which print job information indicated by a pattern of a different color with respect to each user or each job and a different individual name with respect to each user is formed at S side end portions of sheets.

FIG. 7 is a view which shows the sheet 6 of each job in which print web information indicated by a pattern of a different color with respect to each user or each job and a different individual name with respect to each user was formed at S side end portions of the sheets 6.

If the operation panel 5 is set so that print job information is indicated by a pattern of a different color with respect to each user or each job and a different individual name with respect to each user, for example, as shown in FIG. 7, an individual name, which is different with respect to each user is formed by the black development unit 16, on a rear surface of a last page of the sheet 6 of each job, and frames of colors, which are different with respect to each user or each job, are formed by the development units 16 through 19 of each color of Bk, Y, M and C. Meanwhile, it is all right even if a color of an individual name itself, which is formed as print job information, is different with respect to each user or each job, and print job information is combined by a designed pattern of a different color with respect to each user or each job. Types of print job information to be combined, and a combining method can be changed. In this manner, if plural types of print job information are formed in a combined fashion, it is possible to increase patterns of print job information, which are different with respect to each user or each job, and even in an environment in which the complex printer 1 is used by a lot of users and images are formed by a lot of jobs, it is possible to distinguish the sheets 6 printed by oneself, from the sheets 6 printed by other users, and further classify the sheets 6 printed by oneself into the sheets 6 with respect to each job.

Meanwhile, print job information is formed on lower surfaces of the sheets 6 accumulated on the sheet feed tray 7 if an image is formed only on one side of the sheet 6 (one side printing), and print job information is formed on upper surfaces of the sheets 6 in case of duplex printing. A surface, on which print job information was formed, is set as an upper surface at the time that the sheet 6 was ejected on the sheet ejection tray 24. The position where the sheet 6 print job information is formed can be changed.

An operation of the above-described complex machine printer 1 will be explained with reference to FIGS. 1 and 2.

First, as shown in FIG. 2, the H side end portion of the sheet 6, which is accumulated at the uppermost part among the sheets 6 accumulated on the sheet feed tray 7, is fed by the sheet feed roller 9, and carried to the resist roller 10. The resist roller 10 applies resist processing to the sheet 6, and the sheet 6 is carried to an image transfer position where the intermediate transfer belt 20 and the transfer unit 21 face each other. A surface of the photosensitive body 11 is electrostatically charged by the charge unit 13, and on the basis of image data optically read by the image reading unit 4 or electronic data imported from a personal computer etc. The photosensitive body is exposed by the optical unit 15, and an electrostatic latent image is formed. The electrostatic latent image, which was formed on the surface of the photosensitive body 11, is converted into a visible image by the development units 16 through 19 of respective colors, and the image is transferred to the intermediate transfer belt 12. A visible image, which was transferred to the intermediate transfer belt 12, is transferred onto the sheet 6, when the sheet 6, which passed through the resist roller 10, arrives at an image transfer position. The sheet 6, on which the visible image was transferred, is fixed by the fixing unit 22 and carried toward the sheet ejection roller 23. The sheet ejection roller 23 turns the carried sheet 6 toward a direction of ejecting it in a B direction, and if there is no need to carry out duplex printing, a surface of the sheet 6, on which an image was formed, is cast down, and the sheet 6 is ejected onto the sheet ejection tray 24. If there is need to carry out duplex printing, the sheet ejection roller 23 turns the sheet 6 so as to eject it in the B direction, until a T side end portion of the sheet 6 passes through an intersection Q of the sheet carrying path 8 and the sheet carrying path 25. If the T side end portion of the sheet 6 has passed through the intersection Q, the roller 23 is rotated in a reverse direction and carries the sheet 6 to the sheet carrying path 25 with the T side end portion ahead. The sheet 6, which was carried to the sheet carrying path 25, is carried again to the sheet carrying path 8 by the carrying roller 26, and an image is formed on a surface on which an image has not been formed, and the sheet 6 is ejected onto the sheet ejection tray 24 in such a manner that a surface, on which an image is formed later, is cast down. Therefore, in the complex printer 1 of this aspect, in case that image data of 1 job is duplex-printed on the sheet 6, an image of an even number page is firstly formed on one surface of the sheet 6, and later, an image of an even number page is formed on the other surface.

When a document is placed on the document table glass 41 in such a manner that a surface to be read faces the document table glass 41 and the document table cover 43 shown in FIG. 1 is closed, CIS 44 moves in a direction heading from one side surface to the other side surface of the complex printer along the document table glass 41, and on that occasion, reading of the document, which is placed on the document table glass 41, is carried out one line by one line. Then, the complex printer 1 is configured so that it is possible to read the document placed on the document table glass 41 with a surface to be read facing the document table glass 41, in order to obtain digital image data, to form an image on the sheet 6 in the image forming unit 3 on the basis of the obtained digital image data, and in addition, to carry out facsimile transmission/reception etc.

Figure 8:
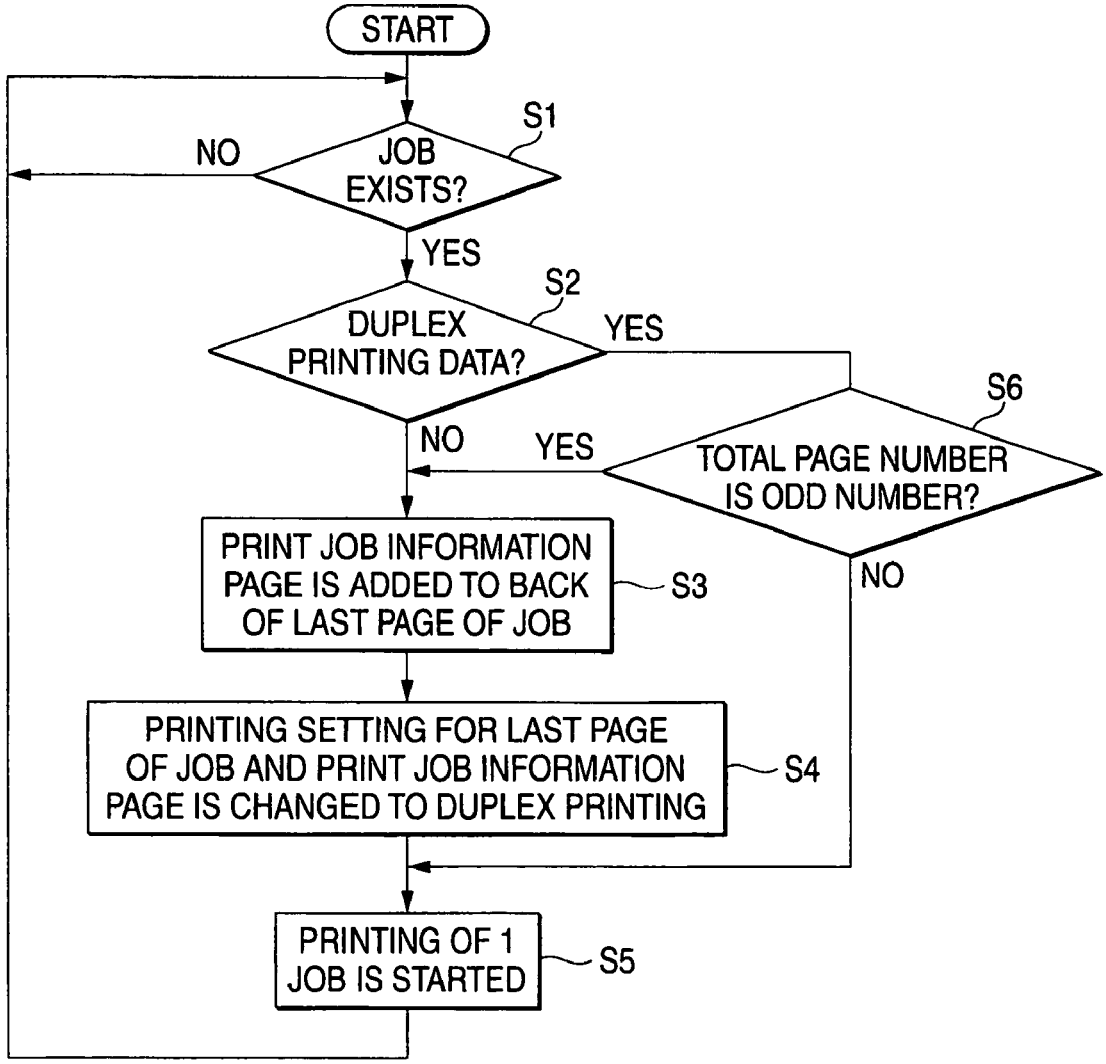
FIG. 8 is a flow chart which shows a control processing operation for controlling in such a manner print job information formed on a rear surface of a last page of sheets.

A control processing operation for controlling a manner in which print job information is formed on a rear surface of a last page of the sheets 6, on which an image is formed, is provided by the control unit 82 of the control device 50, which will be explained by referring to FIG. 8. FIG. 8 is a flow chart which shows a control processing operation for controlling a manner in which print job information is formed on a rear surface of a last page of the sheets 6. Meanwhile, this control processing operation is carried out repeatedly when a power supply of the complex printer 1 is turned ON.

First, it is judged by the judgment unit 81 whether or not a job for forming an image is stored in the hard disc 55 (S1). When it is judged that a job is not stored in the hard disc 55 (S1: No), judgment processing of S1 is carried out until a job is stored in the hard disc 55. When it is judged that a job is stored in the hard disc 55 (S1: Yes), this stored job is read out, and it is judged by the judgment unit 81 whether this print job is duplex printing data or not (S2). When it is judged that the job is one side printing data (S2: No), a page, on which print job information is formed, is added after a last page of a job by the control unit 82 (S3). After addition of a print job information page, printing setting for a last page of a job and the added print job information page is changed to duplex printing (S4). After printing setting for a last page of a job and the added print job information page is changed to duplex printing, image formation of a job, to which the print job information page was added, is started (S5). After image formation start, it goes back to processing in which it is judged whether or not a job is stored in the hard disc 55 in S1.

On the one hand, when it is judged that a job is duplex printing data (S2: Yes), it is judged by the judgment unit 81 whether a total page number of a job is an odd number or an even number (S6). When it is judged that a total page number of a job is an odd number (S6: Yes), it moves to processing of adding a print job information page after a last page of a job in S3. When it is judged that a total page number of a job is an even number (S6: No), a print job information page is not added, and it moves to processing of S5, and duplex printing of a job is started.

As above, if a control processing operation as shown in the flow chart of FIG. 8 is carried out, it is possible to form print job information as described above by use of FIGS. 4 through 7, by effectively utilizing a rear surface of the sheet 6 on which a last page of a job was formed without wasting sheets 6, and it is possible to distinguish the sheet 6 on which an image was formed, from the sheets of each other user or each other job. In addition, even in a duplex-printing 1 job, if a total page number of 1 job is an odd number, it is possible to apply this aspect thereto. On the one hand, the reason that it is controlled so as not to form print job information in case that a total page number of 1 job is an even number is that a previous page of a last page of 1 job is formed on a rear surface of the sheet 6 on which a last page of 1 job is formed and therefore, even if print job information is formed thereon, it exists in a mixed fashion with an image of a previous page of a last page of 1 job. It does not cause such situation that it becomes easy to distinguish the sheet on which an image was formed, with respect to each user or each job.

As above, the present invention was explained on the basis of the aspects, but the present invention is not limited to the aspect at all, and various improvements and modifications are possible within such a scope that it does not depart from its technical concept.

Figure 9:
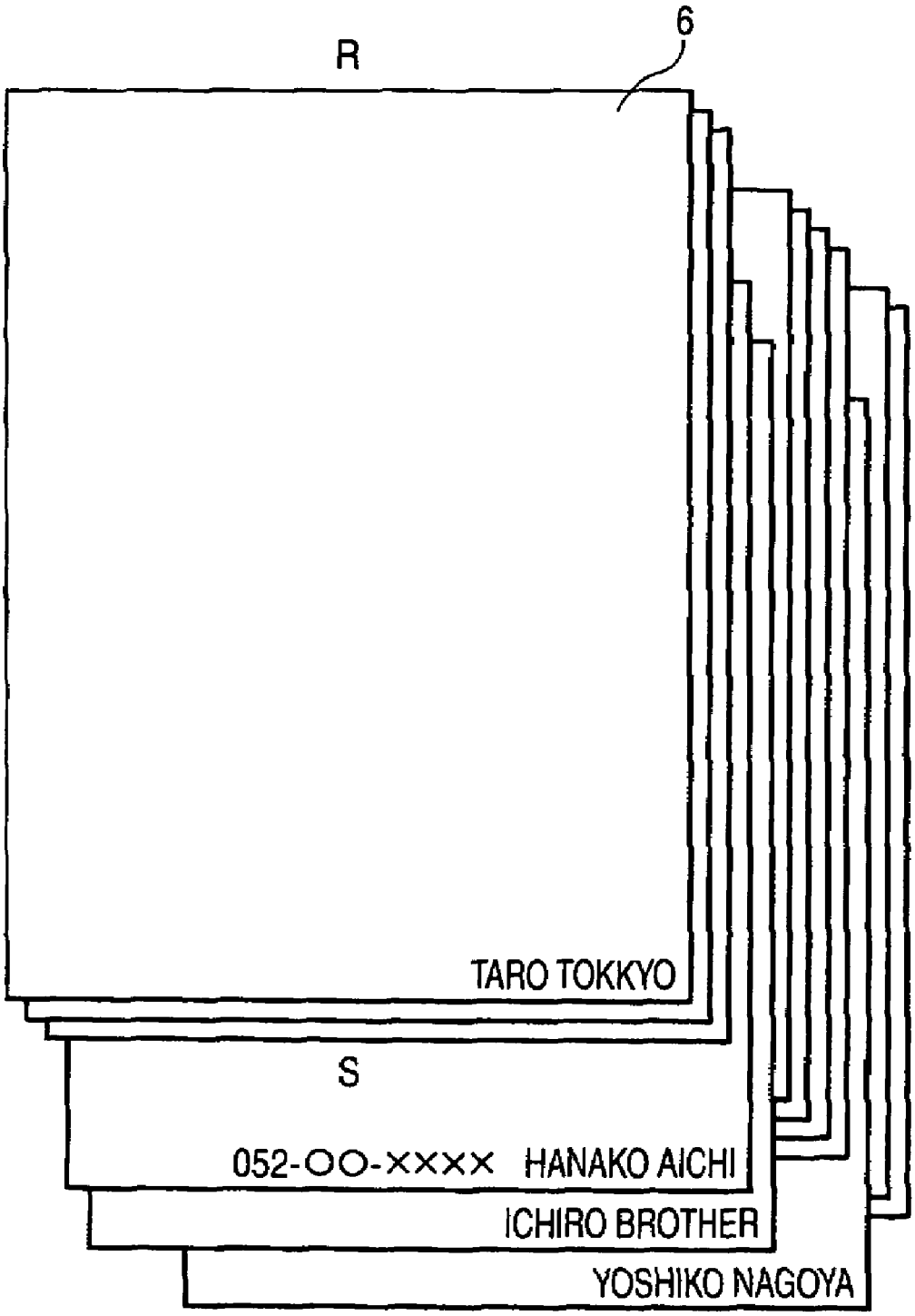
FIG. 9 is a view which shows a sheet of each job in which an order destination telephone number is formed together with print job information by a different individual name with respect to each user at S side end portions of sheets.

For example, for the purpose of ordering by facsimile new products of consumable articles, such as the sheets 6, the photosensitive body 11, the development units 16 through 19 of respective colors, etc., which are consumed when an image forming operation is carried out repeatedly, there is such a case that an order sheet is prepared by PC 61, data of the prepared order sheet is sent to the complex printer 1 through the network I/F 60, the order sheet is printed out by the image forming unit 3, and the printed order sheet is placed on the image reading unit 4 as facsimile transmission unit and facsimile-transmitted to an order destination telephone number by the facsimile communication unit 70. In this case, in case of a configuration of the complex printer 1 as in the aspect, the order sheet is placed on the document table glass 41 of the image reading unit 4 in such a manner that a printing surface of the order sheet is set as a lower surface, but after the order sheet is placed on the document table glass and the document table cover 43 is closed, it is necessary to look for a sheet and a file on/in which a order destination telephone number was written, if the order destination telephone number is not memorized on the occasion of performing facsimile transmission. Moreover, if the order destination telephone number is written on a printing surface of the order sheet, it is necessary to check it again by opening the document table cover 43 and turning over the order sheet, which takes a lot of troubles. Then, as shown in FIG. 9, if an order destination telephone number is formed together with print job information, on a rear surface of an order sheet, it is possible to easily distinguish a printed order sheet out of a bundle of the sheets 6 printed by other jobs, and it is also possible to check an order destination telephone number when an order sheet is placed on the document table glass 41 for the purpose of faxing it.

In addition, if an operation procedure for forming the above-described order destination telephone number on a rear surface of a printing surface of an order sheet and for facsimile-transmitting the order sheet to the order destination telephone number by the image reading unit 4 equipped with a facsimile function is formed, it is possible for even a user who is unaccustomed to an operation to correctly transmit by facsimile the order sheet to the order destination telephone number.

In the aspect, it was configured in such a manner that setting of print job information is carried out by the operation panel 5 of the complex printer 1, but it is all right, as a matter of course, even if it is configured in such a manner that setting can be made on a display of PC 61.

In the complex printer 1 of the aspect, it is configured to be so-called face-down sheet ejection in which a sheet is ejected in such a manner that a printing surface is set as a lower surface at the time of one side printing, but the present invention is also applicable to a printer which carries out so-called face-up sheet ejection in which a sheet is ejected in such a manner that a printing surface is set as an upper surface. In this case, in the complex printer 1 of the aspect, it controlled in such a manner that print job information is formed on an upper surface of a sheet and then, the sheet is ejected, but it is all right if it controls in such a manner that print job information is formed on a lower surface of a sheet and then, the sheet is ejected.

In case that a job is one side printing data, even if control is carried out in such a manner that print job information is formed on a rear surface of the sheet 6 on which a front page of 1 job is formed, without performing control in such a manner that print job information is formed on a rear surface of the sheet 6 on which a last page of 1 job is formed, it is possible to distinguish the sheets 6 with respect to each user or each job, in the same manner.

According to the aspects, even if an image of 1 job is formed on both surfaces of a recording medium, if a total page number of images of 1 job is an odd number, it is possible to form information which is different with respect to each user or each job, on a surface on which an image is not formed, and therefore, it is possible to easily distinguish and take out as compared with a case of sequentially checking a content of an image formed on a recording medium and distinguishing a recording medium of one's own job. In addition, it is possible to prevent of wasting of a recording medium, such as a use of a slip sheet.

According to the aspects, information is formed with a color which is different with respect to each user or each job, on a rear surface of a surface on which an image in a first or last recording medium of a job is formed, and therefore, it is possible to visually distinguish one's own job.

According to the aspects, a pattern is formed with a design which is different with respect to each user or each job, on a rear surface which an image in a first or last recording medium of a job is formed, and therefore, it is possible to obtain the same advantage even in case of a monochromatic image forming apparatus.

According to the aspects, there is a case of forgetting a design which corresponds to one's own job, in case that a pattern was formed with a design which is different with respect to each user or each job. But if an individual name is formed on a rear surface of a surface on which an image in a first or last recording medium of a job is formed, it is possible to surely distinguish a recording medium of one's own job.

According to the aspects, even if forgetting an order destination telephone number after a recording medium is set to facsimile transmission unit with setting a surface on which an order content was formed as a lower surface, there becomes no need to check an order destination telephone number by turning over a lower surface of an already set recording medium each time and to search for a memo on which the order destination number was described and data in which the order destination telephone number was stored.

According to the aspects, even a user who is unaccustomed for a facsimile transmission operation can easily use the image forming apparatus.

What is claimed is:

1. An image forming apparatus comprising:

an image forming unit configured to form an image on front and rear surfaces of a recording medium; and a control unit that controls the image forming unit to form an image that expresses information of a user who uses the image forming apparatus for a job that requires at least three recording media or expresses information identifying the job, only on 1) a rear surface of a recording medium, which corresponds to a first page of the job having an image on a front surface, without forming the image that expresses information of a user who uses the image forming apparatus on other pages of the job, or 2) a last page of the job having an image on a front surface without forming the image that expresses information of a user who uses the image forming apparatus on other pages of the job, or 3) recording media, which corresponds to a first page and a last page of the job with a front surface of each of the first page and the last page having an image, without forming the image that expresses information of a user who uses the image forming apparatus on other pages of the job, wherein, an odd number page of the image of the job is formed on one surface of a recording medium by the image forming unit;

an even number page of the image of the job is formed on the other surface of the recording medium by the image forming unit;

when a total page number of images of the job is an odd number, the control unit controls the image forming unit to form the image that expresses information only on the rear surface of the recording medium that includes the last page of the images of the job; and when a total page number of images of the job is an even number, the control unit controls the image forming unit to prevent the forming of the image that expresses information.

2. The image forming apparatus according to claim 1, wherein the image expressing information of the user or information identifying the job is formed as one of different colors based on the information.

3. The image forming apparatus according to claim 1, wherein the image expressing information of the user or information identifying the job is formed as one of different design patterns based on the information.

4. The image forming apparatus according to claim 1, wherein the image expressing information of the user or information identifying the job is formed as one of different individual names based on the information.

5. An image forming apparatus comprising:

an mage forming unit configured to form an image on front arid rear surfaces of a recording medium;

a control unit that controls the image forming unit to form an image that expresses information of a user who uses the image forming apparatus for a job that requires at least three recording media or expresses information identifying the job, only on 1) a rear surface of a recording medium, which corresponds to a first page of the job having an image on a front surface, without forming the image that expresses information of a user who uses the image forming apparatus on other pages of the job, or 2) a last page of the job having an image on a front surface without forming the image that expresses information of a user who uses the image forming apparatus on other pages of the job, or 3) recording media, which corresponds to a first page and a last page of the job with a front surface of each of the first page and the last page having an image, without forming the image that expresses information of a user who uses the image forming apparatus on other pages of the job;

a consumable article that is consumed by image formation onto a recording medium by the image forming unit; and a facsimile transmission unit that performs a facsimile transmission for ordering the consumable article to an order destination telephone number, wherein the information, which is formed on a rear surface of the recording medium on which the last page of the images of the job and an order content is formed, includes the order destination telephone number.

6. The image forming apparatus according to claim 5, wherein the information further includes an operation procedure for performing the facsimile transmission.

7. An image forming apparatus comprising:

an image forming unit configured to form an image on front and rear surfaces of a recording medium; and a control unit that controls the image forming unit to form an image that expresses information of a user who uses the image forming apparatus for a job that requires a plurality of recording media or expresses information identifying the job, only on 1) a rear surface of a recording medium of the job, which corresponds to a first page of the job having an image on a front surface, without forming the image that expresses information of a user who uses the image forming apparatus on other pages of the job, or 2) a last page of the job having an image on a front surface without forming the image that expresses information of a user who uses the image forming apparatus on other pages of the job, wherein, an odd number page of the image of the job is formed on one surface of a recording medium by the image forming unit;

an even number page of the image of the job is formed on the other surface of the recording medium by the image forming unit;

when a total page number of images of the job is an odd number, the control unit controls the image forming unit to form the image that expresses information only on the rear surface of the recording medium that includes the last page of the images of the job; and when a total page number of images of the job is an even number, the control unit controls the image forming unit to prevent the forming of the image that expresses information.

8. The image forming apparatus according to claim 7, wherein the image expressing information of the user or information identifying the job is formed as one of different colors based on the information.

9. The image forming apparatus according to claim 7, wherein the image expressing information of the user or information identifying the job is formed as one of different design patterns based on the information.

10. The image forming apparatus according to claim 7, wherein the image expressing information of the user or information identifying the job is formed as one of different individual names based on the information.

11. An image forming apparatus comprising:

an image forming unit configured to form an image on front and rear surfaces of a recording medium;

a control unit that controls the image forming unit to form an image that expresses information of a user who uses the forming apparatus for a job that requires a plurality of recording media or expresses information identifying the job, only on 1) a rear surface of a recording medium of the job, which corresponds to a first page of the job having an image on a front surface, without forming the image that expresses information of a user who uses the image forming apparatus on other pages of the job, or 2) a last page of the job having an image on a front surface without forming the image that expresses information of a user who uses the image forming apparatus on other pages of the job;

a consumable article that is consumed by image formation onto a recording medium by the image forming unit; and a facsimile transmission unit that performs a facsimile transmission for ordering the consumable article to an order destination telephone number, wherein the information, which is formed on a rear surface of the recording medium on which the last page of the images of the job and an order content is formed, includes the order destination telephone number.

12. The image forming apparatus according to claim 11, wherein the information further includes an operation procedure for performing the facsimile transmission.

13. An image forming apparatus comprising:

an image forming unit that forms an image on both surfaces of a recording medium;

a control unit that controls the image forming unit to form an image that expresses information of a user who uses the image forming apparatus or a job, on a rear surface of a recording medium, the recording medium including an image of a first page or a last page of the user's job;

a consumable article that is consumed by image formation onto a recording medium by the image forming unit; and a facsimile transmission unit that performs a facsimile transmission for ordering the consumable article to an order destination telephone number, wherein the information, which is formed on a rear surface of the recording medium on which the last page of the images of the job and an order content is formed, includes the order destination telephone number.

* * * * *

UNITED STATES PATENT AND TRADEMARK OFFICE

CERTIFICATE OF CORRECTION

PATENT NO. : 7,529,496 B2
APPLICATION NO. : 11/509578
DATED : May 5, 2009
INVENTOR(S) : Dan

It is certified that error appears in the above-identified patent and that said Letters Patent is hereby corrected as shown below:

In Column 11, Line 40:
Please replace "mage forming" with --image forming--

In Column 11, Line 41:
Please replace "arid" with --and--

Signed and Sealed this

Twentieth Day of October, 2009

David J. Kappos

David J. Kappos
*Director of the United States Patent and Trademark Office*